US006694697B2

(12) United States Patent
Shepherd

(10) Patent No.: US 6,694,697 B2
(45) Date of Patent: Feb. 24, 2004

(54) GRATING WITH CRIMPED INTERSECTIONS

(76) Inventor: John D. Shepherd, 13822 Bruns Rd., Manhattan, IL (US) 60442

( * ) Notice: Subject to any disclaimer, the term of this patent is extended or adjusted under 35 U.S.C. 154(b) by 0 days.

(21) Appl. No.: 09/974,607

(22) Filed: Oct. 9, 2001

(65) Prior Publication Data

US 2003/0066260 A1 Apr. 10, 2003

(51) Int. Cl.[7] ..... E04C 2/42

(52) U.S. Cl. ..... 52/668; 52/507; 52/302.3; 404/36; 29/897.15

(58) Field of Search ..... 52/660, 664, 668, 52/507, 656.8, 302.3, 177, 669; 404/45, 36; 29/897.15; 403/346; 14/73

(56) References Cited

U.S. PATENT DOCUMENTS

| | | | | | |
|---|---|---|---|---|---|
| 1,573,154 | A | * | 2/1926 | Gelder | 52/667 |
| 2,082,197 | A | * | 6/1937 | Bates | 52/667 |
| 3,177,990 | A | * | 4/1965 | Flucker et al. | 52/667 |
| 3,651,552 | A | * | 3/1972 | Allen | 29/897.15 |
| 4,438,726 | A | * | 3/1984 | Osthoff | 119/450 |
| 4,566,243 | A | * | 1/1986 | Dahlin | 52/578 |
| 4,665,674 | A | * | 5/1987 | Brugman | 52/506.06 |
| 4,680,910 | A | * | 7/1987 | Perk | 52/664 |
| 4,757,663 | A | * | 7/1988 | Kuhr | 52/481.1 |
| 4,760,680 | A | * | 8/1988 | Myers | 52/669 |
| 4,928,471 | A | * | 5/1990 | Bartley | 52/664 |

FOREIGN PATENT DOCUMENTS

GB 2106948 * 4/1983

OTHER PUBLICATIONS

Web pages of IKG Industries at www.ikgindustries.com: Home; Product Line Overview; Weldforged Steel Grating; Pressure Locked Grating; Riveted Grating; Date unknown, but prior to date of present invention.

* cited by examiner

*Primary Examiner*—Winnie Yip
(74) *Attorney, Agent, or Firm*—Greer, Burns & Crain, Ltd.; Philip M Kolehmainen

(57) ABSTRACT

Main bars end intersecting cross bars each have mated slots in their aligned edges. Deformable pairs of arms on one of the sets set of bars are crimped into openings in the other set of bars at the bar intersections to hold the bars together and make a strong and attractive grating.

6 Claims, 2 Drawing Sheets

GRATING WITH CRIMPED INTERSECTIONS

FIELD OF THE INVENTION

The present invention relates to gratings and more particularly to an improved grating with bars attached at intersections by crimping.

DESCRIPTION OF THE PRIOR ART

Gratings (also called grilles, lattices, louvers, etc), of many types are used for many purposes. A typical grating includes a number of main bars or bearing bars extending generally parallel in a first direction, with cross bars or support bars extending in a transverse direction. The bars are attached at the intersections to form a single structure. For load bearing applications, the main and/or cross bars are relatively strong and are structurally supported. Examples of load bearing gratings are those used for floors or convector grilles in floors. Gratings can also be used as decorative grilles where high strength is not required.

One well known type of grating is made by welding the main bars and cross bars together at the intersections. A problem with this approach is that expensive equipment or a large amount of labor is required to make the numerous welds required for a grating. Another problem is that welds can be messy, requiring post assembly cleaning and trimming of weld splatter and smoke discoloration. A further disadvantage is that welding may not be practical when the main and cross bars are of dissimilar materials.

In order to overcome disadvantages of welding, gratings are made using a tight tolerance press fit. Slots in the main and cross bars are mated at the intersections with a very large force and the resulting interference fit mechanically holds the assembly together. The equipment needed to make this type of grating is specialized and very expensive. In addition, the close tolerances needed for the bar structures adds to the cost.

Other gratings are made with fasteners. For example, rivets can be used to attach crimp bars to main bars to make a strong load bearing grating. This type of grating is expensive and time consuming to make due to the riveting process in addition, for many architectural applications, a riveted grating is not as attractive as a grating having a simple, clean, geometrical pattern of crossing bars.

SUMMARY OF THE INVENTION

Objects of the present invention are to provide an improved grating that can be made with a minimum of labor and machinery expense; to provide a grating that has an attractive, neat appearance without requiring any post assembly cleaning; to provide a grating that can be made of bars of a wide variety of different materials sizes and shapes; to provide a grating that has ample strength for load bearing applications and that has an attractive appearance for decorative applications; and to provide a grating overcoming disadvantages of gratings known in the past.

In brief, in accordance with the invention there is provided a grating including a plurality of first bars and a plurality of second bars and a plurality of intersections of the first and second bars. The first and second bars include edges and slots in the edges. Each first bar includes deformable arms adjacent the slots in the first bar. Each second bar includes recesses adjacent the slots in the second bar. Each intersection includes aligned and interfitted slots of the first and second bars. The slot of the first bar receives the second bar and the slot of the second bar receives the first bar. A deformable arm of the first bar is crimped to extend in locking engagement into a recess of the second bar.

BRIEF DESCRIPTION OF THE DRAWING

The present invention together with the above and other objects and advantages may best be understood from the following detailed description of the preferred embodiment of the invention illustrated in the drawings, wherein.

DETAILED DESCRIPTION OF THE PREFERRED EMBODIMENTS

Figure 1:
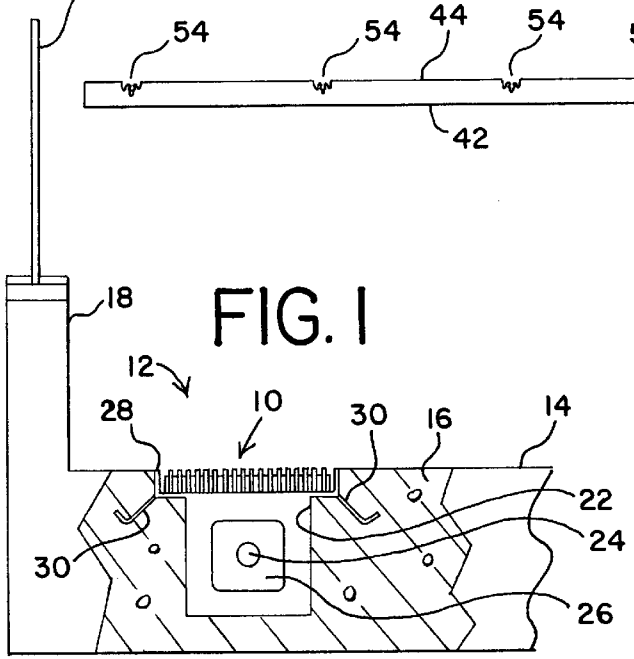
FIG. 1 is a simplified elevational view, partly in section, of a portion of a floor and wall of a building including a convection grille having a grating constructed in accordance with the present invention.

Having reference now to FIG. 1, there is illustrated a typical application for a grating 10 constructed in accordance with the principles of the present invention. In this application the grating 10 is part of a convector grille assembly 12 in a building 14, portions of which are shown in simplified outline. Building 14 includes a poured concrete floor 16, a wall 18 and a window 20. A void 22 in the floor 16 holds a heater 24 with fins 26 for providing heat within the building 14 below the window 20. The convector grille 12 including the grating 10 permits heated air to flow from the void 22 into the region above the floor 16.

In the typical installation seen in FIG. 1, the grating 10 is incorporated into the surface of the floor 16 and is load bearing. It has ample strength to support the weight of floor borne pedestrian and equipment traffic and the like. The grille assembly 12 can include one or a number of gratings 10 depending on the size of the grille assembly 12. The grating 10 rests in a frame 28 made of metal angles supported at the mouth of the void 22 and serving to support the grating 10 and transfer loads from the grating to the floor 16. Additional structural support may be used under the grating 10 if desired. Hook anchors 30 attached to the frame 28 are embedded in the concrete floor 16 to hold the frame 28 in place. The FIG. 1 illustration is but one of many applications for the grating 10 of the present invention, and the grating 10 is adaptable to other load bearing and decorative applications.

Figure 2:
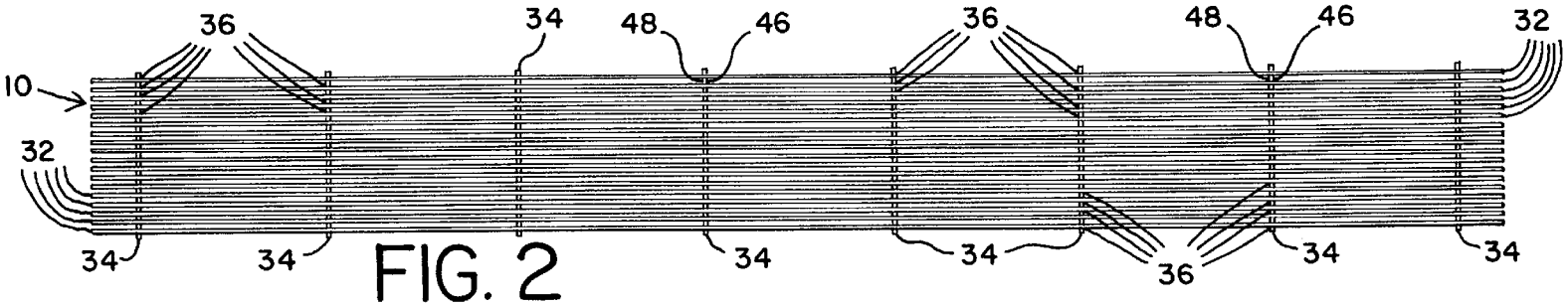
FIG. 2 is a top plan view of the grating.

As seen in FIG. 2, the grating 10 includes a number of main bars or bearing bars 32 spaced apart and extending parallel to one another in a first direction. A number of spaced apart cross bars or support bars 34 extend parallel to one another in a second direction perpendicular to the main bars 32. In the preferred embodiment seen in the drawings, the grating 10 is thirteen inches wide and sixty inches long. There are eighteen, sixty inch long main bars at a 0.375 inch center to center spacing, and eight, thirteen inch long cross bars 34 at an eight inch center to center spacing. The grating 10 includes numerous intersections 36 where a main bar 32 intersects a cross bar 34. In the illustrated embodiment there are 144 intersections 36 in the grating 10. To suit the requirements of other applications, the grating could include different numbers of main and cross bars at different spacings.

Because the grating 10 is used in a load bearing architectural application, the bars 32 and 34 have sufficient strength to bear anticipated loadings. In addition the bars are made of a material or of materials compatible with the installation. In the illustrated embodiment, the bars 32 and 34 are made of stainless steel bar stock. The main bars 32 have a rectangular cross section of one-eighth inch by one inch and the cross bars 34 have a rectangular cross section of one-eighth inch by three-quarter inch. The numbers, lengths, widths and heights of the bars 32 and 34 can be varied and tailored to the requirements of the particular application in which the grating 10 is to be used. In addition the bars 32 and 34 can be made of a variety of materials. The bars 32 can be made of a different material than the bars 34 if desired, and the different materials could be materials unsuited to welding such as brass and steel or metal and plastic.

Each main bar 32 has opposed flat side surfaces 38 and 40, an upper edge 42 and a bottom edge 44. Similarly, each cross bar 34 has opposed flat side surfaces 46 and 48, a top edge 50 and a bottom edge 52. When the grating 10 is assembled, the bottom edges 44 and 52 are coplanar in a flat plane for solid support in the frame 28, and the top edges 42 of the main bars 32 project above the top edges 50 of the cross bars 34 to provide the desired appearance in the grille 12. These configurations can be altered to provide other functions and appearances.

Figure 4:
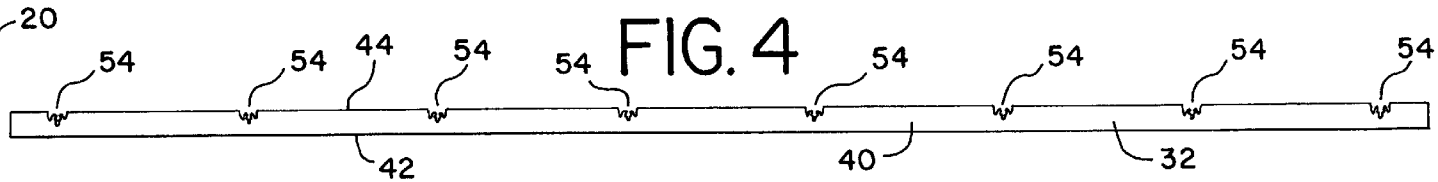
FIG. 4 is an elevational view of an inverted main bar of the grating.
Figure 3:
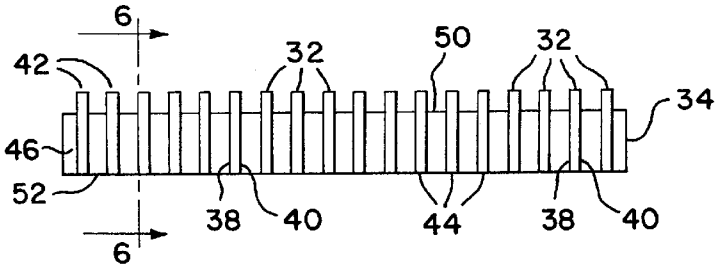
FIG. 3 is an enlarged end view of the grating.
Figure 5:
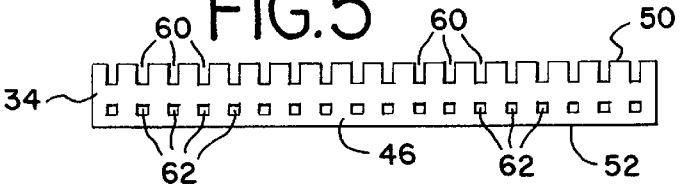
FIG. 5 is an enlarged elevational view of a cross bar of the grating.
Figure 6:
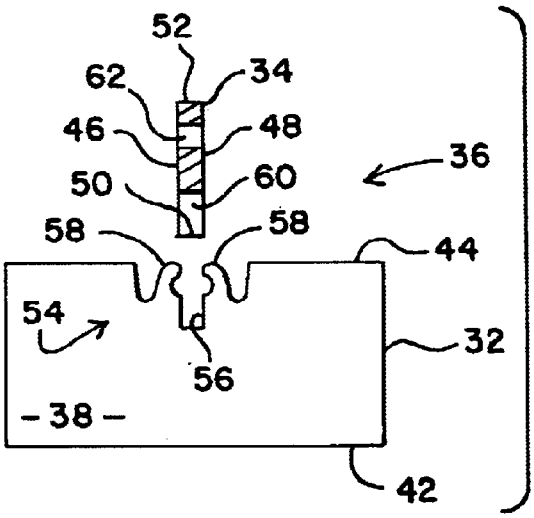
FIG. 6 is a greatly enlarged, inverted, sectional view taken along the line 6—6 of FIG. 3 of an intersection of a main bar and a cross bar of the grating, except that FIG. 6 shows the main and cross bars before they are assembled.
Figure 7:
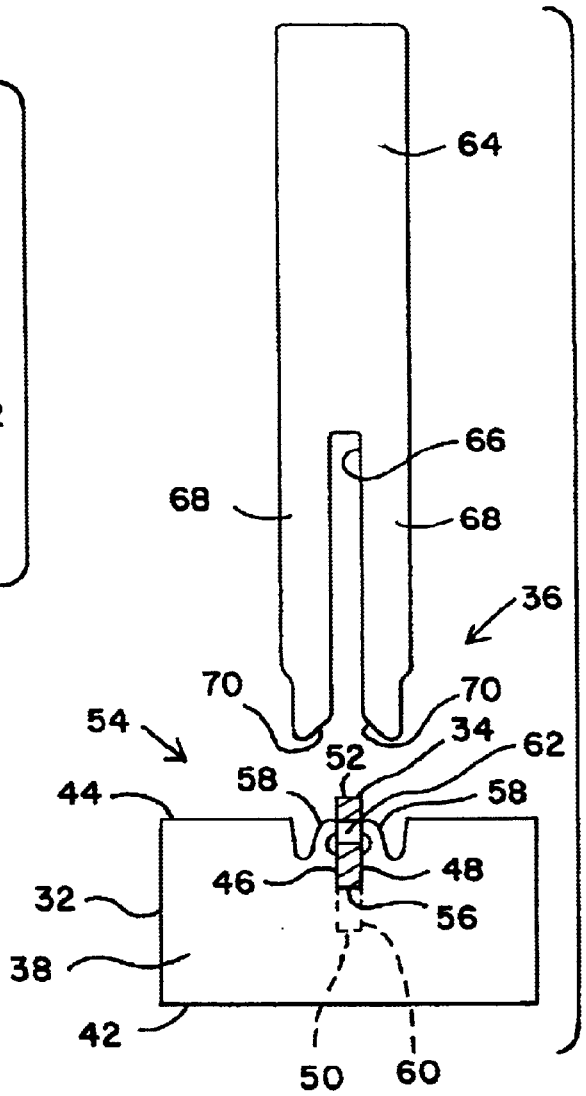
FIG. 7 is a view like FIG. 6 showing the main and cross bars together with an assembly tool during assembly of the main and cross bars.

In accordance with the present invention, the main bars 32 and the cross bars 34 are attached together by crimping or clinching at the intersections 36 to provide a strong, neat appearing, economical grating. Each main bar 32 includes a series of seat structures 54 spaced along its bottom edge 44 as seen in FIG. 4. There is one seat structure 54 for each cross bar 34. Referring to FIG. 6, each seat structure 54 includes a slot 56 extending from the bottom edge 44. In the illustrated embodiment, the slots 56 are about one-half inch deep and are wide enough to slideably receive the one-eighth inch thick cross bars 34. The lower portions of the slots 56 are flanked by and defined by a pair of opposed deformable clinching arms 58. As seen in FIGS. 6 and 7, the tips of the arms 58 defining the mouths of the slots 56 before assembly of the grating 10 are spaced apart by a distance sufficient to receive the one-eighth inch thick cross bars 34. The arms 58 do not protrude from the bars 32 and are entirely within the rectangular cross sectional profile of the bar 32.

Each cross bar 34 includes a series of slots 60 in its upper edge 50. There is one slot 60 for each main bar 32. In the illustrated embodiment the slots 60 are about one-quarter inch deep and wide enough to slideably receive the one-eighth inch thick main bars 32. Aligned below each slot 60 is an opening 62 extending through the cross bar 34 between the opposed side walls 46 and 48. The mouths of the openings 62 define recesses in the opposed side walls 46 and 48. In the illustrated embodiment the openings 62 are about one-eighth inch square and are spaced about one-quarter inch from the bases of the slots 60.

Figure 8:
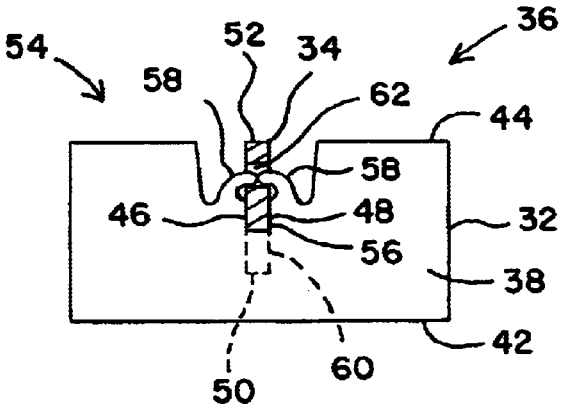
FIG. 8 is a view like FIGS. 6 and 7 showing the main and cross bars in assembled condition.

The method of assembling the grating 10 is illustrated in FIGS. 6–8. Each intersection 36 includes one seat structure 54 of one main bar 32 and one slot 60 of one cross bar 34. One intersection 36 is seen in FIGS. 6–8. As seen in FIG. 6, to assemble the grating 10, the slots 60 are aligned with the slots 56 of the seat structures 54. To facilitate assembly, the bars 32 and 34 may be inverted as seen in FIGS. 6–8. The intersections 36 may be assembled individually or in groups. The cross bars 34 may be assembled seriatim to the main bars 32 or more than a single bar may be assembled at one time.

When a slot 60 of a cross bar 34 is aligned with a seat structure 54 of a main bar 32, the bars are moved toward one another so that the slots 56 and 60 are mated or interfitted. This can be done by supporting the inverted top edge of the main bar on a horizontal work surface (not shown) and moving the cross bar 34 down until its bottom edge 52 is coplanar with the bottom edge 44 of the main bar 32. When the slots 56 and 60 are mated and interfitted as seen in FIG. 7, the slot 56 of the main bar 32 receives the side walls 46 and 48 of the cross bar 34 and the slot 60 of the cross bar 34 receives the side surfaces 38 and 40 of the main bar 32.

The next step in the assembly method is to use an assembly tool 64 to deform the arms 58 so that they are crimped or clinched into the openings 52 to securely mechanically lock the main bar 32 and the cross bar 34 to one another at each intersection 36. The tool 64 includes a slot 66 separating two crimping legs 68. The tool 64 is moved down from the position seen in FIG. 7 and the legs 68 travel down the opposite side surfaces 46 and 48 of the cross bar 34 into engagement with the deformable arms 58. Crimping surfaces 70 contact the arms 58 and force them downwardly and inwardly into the openings 62. The end portions of the crimped arms 58 engage the upper surfaces of the openings (the bottom surfaces as seen in inverted FIG. 8) to capture the cross bar 34 tightly in the slots 56 of the seat structures 54. The crimping operation can be performed with a single tool 64, one intersection 36 at a time. If desired a number of tools 64 can be ganged together and a number of crimps can be made in a single operation. The crimps can be made manually, or a suitable press can be used to make the crimps by machine.

The crimped connections at the intersections 36 provide a strong attachment of the cross bars 34 and main bars 32 and a strong resulting grid 10. The crimped connections do not extend laterally beyond the profiles of the intersecting bars, resulting in a neat, clean and trim appearance. From above the installed grid (FIG. 1) the crimped connections at the intersections 36 cannot readily be seen. No post assembly cleanup is needed. Expensive equipment is unnecessary, and manual operations are minimized. The crimped grating assembly can be made in many configurations and of many diverse materials.

While the present invention has been described with reference to the details of the embodiment of the invention shown in the drawing, these details are not intended to limit the scope of the invention as claimed in the appended claims.

What is claimed is:

1. A grating comprising a plurality of first bars and a plurality of second bars and a plurality of intersections of said first and second bars;

said first and second bars each including edges, one said edge of each said first bar including first slots, and one said edge of each said second bar including second slots;

each said first bar including preformed deformable arms adjacent said first slots in said first bar;

each said second bar including recesses adjacent said second slots in said second bar;

each intersection including aligned and interfitted first and second slots of said first and second bars, said first slot of said first bar receiving said second bar, the second slot of said second bar receiving said first bar, and one of said deformable arms being deformably crimped to extend in locking engagement into one of said recesses.

2. A grating as claimed in claim 1, each said first bar including a pair of said preformed deformable arms flanking each said first slot in said first bar;

each said second bar including an opposed pair of said recesses adjacent each said second slot in said second bar; and each intersection including a pair of said deformable arms crimped to extend in locking engagement into said opposed pair of said recesses.

3. A grating as claimed in claim 2, said second bars having opposed side surfaces, said opposed pairs of recesses being defined by openings extending through said second bars between said opposed side surfaces.

4. A grating as claimed in claim 3, each said second bar having a second edge opposite said one edge edges of said second bar, said second edges of said second bars and said edges of said first bars being in a common plane.

5. A grating as claimed in claim 2, said each said first slot of said first bar being defined at least in part by said flanking pair of preformed deformable arms.

6. A method of making a grating comprising the steps of;

aligning slots in edges of first bars with slots in edges of second bars at intersections of the first and second bars;

preforming deformable arms on the first bars adjacent the slots of the first bars;

moving the first and second bars together to mate the slots so that the slots of each bar receive the other bar; and after said moving, crimping the preformed deformable arms adjacent the slots of the first bars into openings adjacent the slots in the second bars by a crimping tool to interlock the first and second bars together.

* * * * *